US005432953A

United States Patent [19]

Kim

[11] Patent Number: 5,432,953

[45] Date of Patent: Jul. 18, 1995

[54] NECK TIE STRUCTURE WITH A TIE KNOT FORMER

[76] Inventor: Yong J. Kim, 7020 Glenwood St., Hanover Park, Ill. 60103

[21] Appl. No.: 190,991

[22] Filed: Feb. 3, 1994

[51] Int. Cl.[6] ..... A41D 25/02; A41D 25/04; A41D 25/16

[52] U.S. Cl. ..... 2/148; 2/149; 2/150; 2/152.1; 2/153; 2/155

[58] Field of Search ..... 2/144, 145, 146, 147, 2/148, 149, 150, 151, 152.1, 153, 154, 155, 156, 157, 52, 300, 301, 310, 311, 312, 338

[56] References Cited

U.S. PATENT DOCUMENTS

| | | | |
|---|---|---|---|
| 353,486 | 11/1886 | Eschner | 2/149 |
| 871,569 | 11/1907 | Davis | 2/155 X |
| 979,521 | 12/1910 | Lyon | 2/148 |
| 1,598,733 | 9/1926 | Lettré | 2/153 |
| 3,335,427 | 8/1967 | Eads | 2/155 |
| 3,506,978 | 4/1970 | Santona | 2/156 X |
| 3,780,381 | 12/1973 | Najarian . | |
| 4,000,523 | 1/1977 | Woods . | |
| 4,173,792 | 11/1979 | Intengan | 2/150 X |
| 4,513,453 | 4/1985 | Chen et al. . | |
| 4,627,113 | 12/1986 | Lord . | |
| 4,656,672 | 4/1987 | Lande . | |
| 4,710,982 | 12/1987 | Lande . | |
| 4,856,115 | 8/1989 | Knapp . | |
| 4,875,239 | 10/1989 | Patterson, Jr. . | |
| 4,958,383 | 9/1990 | Thompson . | |
| 5,165,112 | 11/1992 | Dawes . | |
| 5,170,507 | 12/1992 | Langford et al. . | |
| 5,218,722 | 6/1993 | Vandenberg | 2/152.1 |

*Primary Examiner*—Jeanette E. Chapman
*Attorney, Agent, or Firm*—Charles F. Meroni, Jr.

[57] ABSTRACT

This invention concerns a neck tie structure, a tie, a neck band, and a knot former. The knot former has a groove extending from side to side on the knot former. The neck band is threaded through the groove. The neck band has fastener means at opposite ends to connect the neck band on a neck of a person wearing the tie. The tie has an intermediate tie loop portion mounted over a front face of the knot former with ends of the tie being projected along opposite sides and rearwardly of the knot former and rearwardly and beneath the neck band. The ends of the tie are extended upwardly and forwardly over the neck band between the intermediate tie loop portion and the knot former and downwardly beneath the knot former in lapped relation, the thus tied tie generating a tied knot about the knot former having an appearance of a four-in-hand knot.

17 Claims, 2 Drawing Sheets

NECK TIE STRUCTURE WITH A TIE KNOT FORMER

BACKGROUND OF THE INVENTION

The present invention concerns a new and improved neck tie structure with a tie knot former. Various types of neck tie structures have been invented and patented in the U.S.A. before and none of the patents known are believed to anticipate the improved features of my new neck tie structure. My new neck tie structure is of a simplified construction in that it includes a minimum number of components comprising a neck tie, a knot former, and an elastic neck loop and hook type fasteners sold under the trademark "Velcro" for quick attachment of the elastic neck band around a person's neck. These fasteners maybe of any suitable type. One important feature of my new neck tie structure involves a unique way for attaching and tying a relatively short in length neck tie to the knot former and the elastic neck band. By using the inventive features of my new and improved neck tie structure, the length of the tie can be reduced by as much as one-third, thus reducing the costs for manufacture of a tie so since the tie can be easily assembled and/or disassembled with respect to the knot former and the elastic band, it is easy to either wash or clean the tie and then restore the tie to the neck tie structure by refolding the tie in assembly with the neck tie knot former and the elastic band.

A variety of different neck ties have been the subject of earlier issued U.S. Patents. Only a few of the prior a neck tie patents are concerned with the use of a knot former as required by my new and improved neck tie structure. With regard to prior a patents relating to the use of neck tie formers, attention is directed to U.S. Pat. No. 4875239. In this patent, the former 20 is attached to a neck band by pins 25 in slot 18 in the neck band 14 as shown in FIG. 8. This arrangement is more complicated than my improved neck tie structure where the neck band is joined with the neck tie former by inserting the neck band through a groove molded in the knot former. My neck tie is also tied with the neck tie structure in a new and improved way not shown in this patent.

U.S. Pat. No. 5,170,507 shows another type of a preformed neck tie with an insert shown in FIG. 2. The construction in assembly of this insert is more complicated and differs from the improved neck tie structure that is the subject of this patent disclosure. Other types of knot simulating tie clasps are shown in U.S. Pat. No. 5,216,757. Still further, U.S. Pat. No. 3,737,917 utilizes a bridge member 31 (FIG. 4) for assisting in the formation of the knot. Still other neck ties having other types of knot formers are shown in U.S. Pat. Nos. 3,761,963 and 3,761,964.

According to important features of my invention, my neck tie structure has been provided with a knot former that is slidably mounted on a neck band and my neck tie is tied in a looped manner about the neck band and the knot former which improved arrangement makes it possible to eliminate any need for tie tacks or other types of connectors such as are shown in the prior art for the purpose of securing the tie to other components of the neck tie structure thus constituting another important advantage of my invention.

SUMMARY OF THE INVENTION

According to my present invention I have provided a neck tie structure which includes, a tie, a neck band, and a knot former. The knot former has a groove extending from side to side on the knot former. The neck band is extended through the groove. The neck band has fastener means at opposite ends to connect the neck band on a neck of a person wearing the tie. The tie has an intermediate tie loop portion mounted over a front face of the knot former with ends of the tie being projected along opposite sides and rearwardly of the knot former and rearwardly and beneath the neck band. The ends of the tie are extended upwardly and forwardly over the neck band between the intermediate tie loop portion and the knot former, the tie ends are extended downwardly beneath the knot former in lapped relation, the thus tied tie generating a tied knot about the knot former which includes the intermediate tie loop portion.

Another feature of my invention concerns the use of a neck tie structure as previously described wherein the knot former has its groove formed in an arcuate shape which extends from one side of the knot former to an opposite side thereof, the neck band when extended through the groove being flexible and shaped to adopt the arcuate shape of the groove.

Still another feature of my invention relates to a neck tie structure as previously described wherein the knot former is of a wedge shaped configuration having a curved front face providing a knot forming surface when the intermediate tie portion is looped in engagement over this knot forming surface.

According to important features of my invention, I have provided a new and improved combination, the combination comprising a neck tie structure, the neck tie structure including: a tie, an elastic neck band, and a knot former, the knot former having a groove extending from side to side on the knot former, the elastic neck band being threaded through the groove, the elastic neck band having fastener means at opposite ends to connect the opposite ends of the elastic neck band on a neck of a person wearing the tie, the tie having an intermediate tie loop portion mounted over a front face of the knot former with ends of the tie extended along opposite sides and rearwardly of the knot former and rearwardly and beneath the elastic neck band, tie portions of the tie being extended upwardly and forwardly over the elastic neck band between the intermediate tie loop portion and the knot former, the tie portions being extended downwardly beneath the knot former in lapped relation to one another, the thus tied tie coacting with the knot former to generate an enlarged tied knot simulating a four-in-hand neck tie knot. Other and still further features of my invention relate to a neck tie structure which includes a tie, a neck band structure. The neck band structure includes a neck band, and a wedge-shaped knot former. The wedge-shaped knot former has a groove formed in an arcuate shape extending across from side to side on the wedge-shaped knot former, the neck band being loosely extended through the groove for relative arcuate movement to the wedge-shaped knot former, the neck band having fastener means at opposite ends to connect the opposite ends of the neck band on a neck of a person wearing the tie, the tie having an intermediate tie loop portion mounted over and confronting a front face of the wedge-shaped knot former with the intermediate tie loop portion of the tie extended along opposite sides and rearwardly of the knot former and rearwardly and beneath the neck band, said intermediate tie portion being extended upwardly and forwardly over the neck band between the intermediate tie loop portion and the wedge-shaped knot former, the intermediate tie being extended downwardly beneath the wedge-shaped knot former in lapped relation to one another, the thus tied tie coacting with said knot former to generate an enlarged knot, the tie former having an outwardly bulged curved front face, tapered side areas extending rearwardly on opposite sides of the outwardly bulged curved front face for allowing a tie knot to resemble a "four-in-hand" tie knot, said knot to be tied over the outwardly bulged front face and the tapered side areas.

Other objects and advantages of this invention will become apparent from the following description taken in conjunction with the accompanying drawings wherein are set forth by way of illustration and example a certain embodiment of my invention.

DETAILED DESCRIPTION OF THE PREFERRED EMBODIMENT

Figure 1:
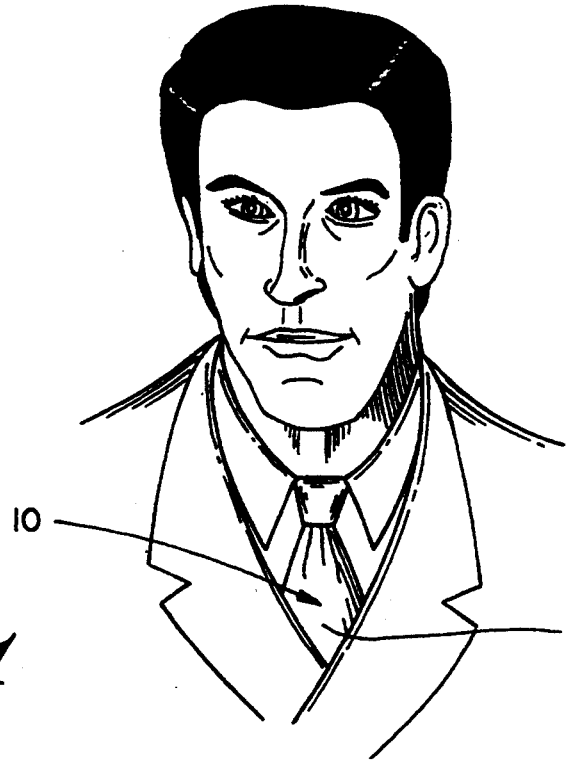
FIG. 1 is a front elevation of a person wearing my neck tie structure which embodies important features of my invention.

According to my invention, I have provided a new and improved neck tie structure as indicated at 10. The neck tie structure 10 includes a tie 11. This tie is of a conventional construction except that it is substantially shorter and is as much shorter as one-third (⅓) as compared to ties commonly worn today. As is known, with taller people, the ties are of a longer length than they are for shorter people. In either case, whether the tie is to be used on a shorter person or a taller person, the length of the tie can be shortened by as much as one-third (⅓) in length when manufactured in accordance with the principles of my invention.

According to my invention, my neck tie structure also includes a neck band structure 11 having a neck band 12. A fabric band sleeve 13 is mounted on the neck band 12. This sleeve has a larger diameter than the neck band 12 so that it can loosely slide and move relative to the neck band 12. This sleeve is secured by side stitches along its length so that opposite edges of the fabric band sleeve 13 are securely joined together.

The neck band 12 also has opposite band ends 15 and 16. A fastener structure 17 is secured to the ends 15 and 16 which includes a pair of fastener strips 18 and 19 which can be of the type commonly sold under the trademark "Velcro" and suitably secured to the neck band 12. These strips, when engaged together have hooks which interact to hold the fastener strips 18 and 19 in mated engagement together. These strips can readily be pulled apart in a conventional way. Attention is directed to certain U.S. Patents pertaining to fastener strips of this type and in this regard typical fastener strips are shown in U.S. Pat. Nos. 3,658,107, 3,732,600, 4,591,148 and 4,708,183. When the fabric band sleeve 13 is mounted on the neck band 12, the sleeve 13 is bunched as indicated generally at 20 along the length of the fabric band sleeve 13. Stitching indicated at 21 and 22 secures opposite ends of the fabric band sleeve 13 to the neck band 12 in adjacency to fastener strips 18 and 19 located at opposite ends of the neck band 12. These stitches indicated at 21 and 22 serve to hold the fabric band sleeve in a bunched position on the neck band 12 so that when the neckband is stretched due to its elasticity, the bunching of the fabric of the fabric band sleeve 20 can also expand with the elastic neck band 12 to move in unison together. The fabric sleeve 20 can match the fabric of the tie 11.

Figure 2:
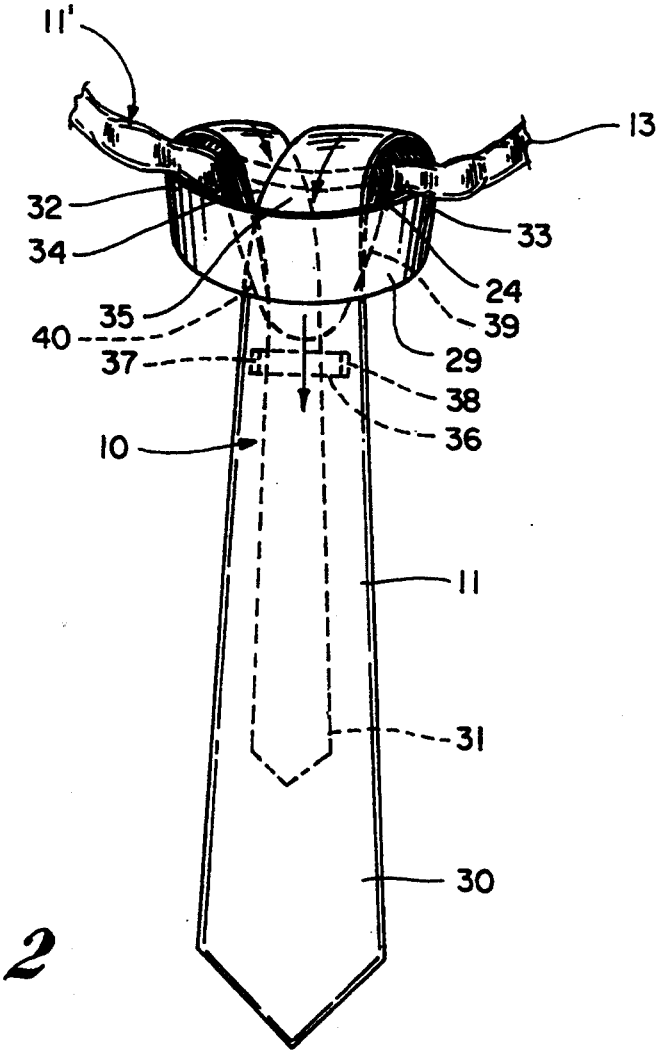
FIG. 2 is an enlarged front view of the neck tie structure shown in FIG. 1, the arrows and the full and dotted lines showing the way in which the components of the neck tie are manipulated to place them into proper position.
Figure 3:
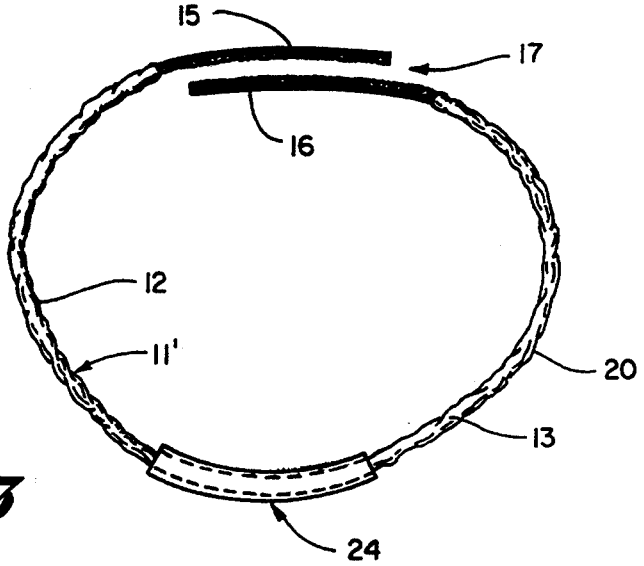
FIG. 3 is a top plan view of components of my neck tie structure including a neck band structure and a tie former.
Figure 4:
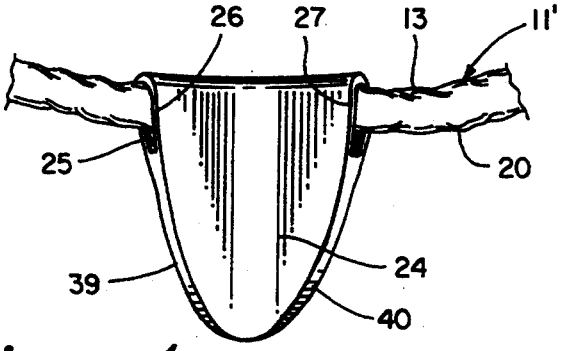
FIG. 4 is an enlarged rear elevation of the former shown in FIG. 3 when mounted on a neck band structure.
Figure 5:
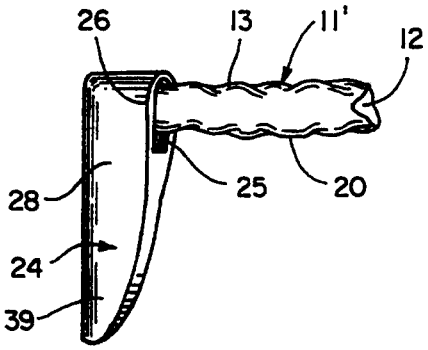
FIG. 5 is an enlarged edge view of the knot former as shown in FIG. 4.
Figure 6:
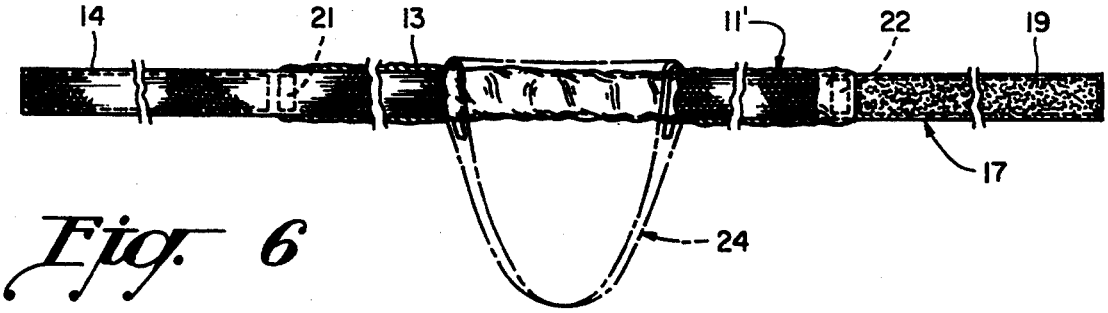
FIG. 6 is an enlarged fragmentary partially sectioned rear view of the neck band structure when mounted upon the neck tie former.
Figure 7:
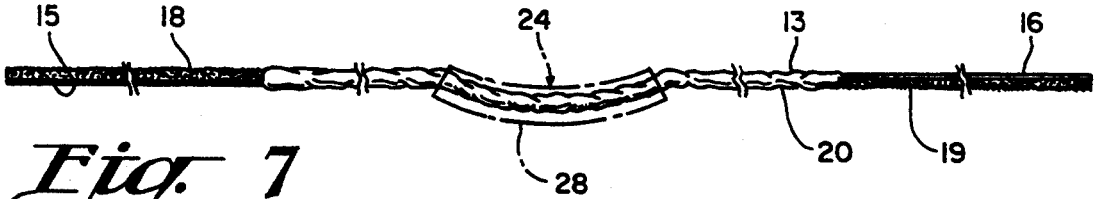
FIG. 7 is an enlarged fragmentary top plan view of the assembly shown in Figure 6.

Another important component of my neck tie structure 10 is a wedge-shaped tie former 24. The former can be preferably formed of a synthetic plastic of any suitable type which has a firm body character to it to provide a firm backing for enabling the tie 11 to be folded about the former 24 as hereafter described which embodies important features of my invention. This former has a side-to-side extending arcuate or curved groove which intercepts opposite sides 26 and 27 of the tie former as shown in FIGS. 4 and 5. It will further be seen .that the groove 25 is curved and is of a relatively firm nature so that a curved portion of the neck band 12 approximates the confirmation of a person's neck and can readily hug the person's neck when extended through the wedge-shaped tie former 24. My tie former 24 is also provided with a curved front former face or a radially outwardly bulged curved front former face 28, to assist in forming a curved neck tie knot when the neck tie 11 is mounted on the tie former 24 as shown in FIGS. 2 and 6, as an example. This neck tie knot simulates a so-called "four-in-hand Knot" or enlarged knot which can now be created with a neck tie of a considerably shorter length than before, where such tie is used with my new and improved uniquely configured neck tie knot former 24.

To mount the tie 11 on the neck tie structure, the tie is first manipulated to provide a looped tie portion 29 which engages against a curved front face 28 of the tie former 24. Tie ends 30 and 31 are provided. Intermediate tie sections or portions 32 and 33 are looped beneath neck band. The intermediate tie portions or sections 32 and 33 also include extended sections 34 and 35 looped beneath the tied portion 29. An inner tie folding band 36 is stitched at 37 and 38 to a back side of outer main tie flap 39 so that inner, relatively thin, tie flap 40 can be held by the band 36 behind the main tie flap 39 in centered relation relative thereto.

The tie former is also provided with tapered side areas 39 and 40 which extend rearwardly on opposite sides of the outwardly bulged curved front face of the former for allowing the tie knot to resemble a "four-in-hand" tie knot to be tied over the outwardly bulged front face and the tapered side areas. By providing a curved front face on the knot former along witht the tapered side areas 39 and 40, the user of my neck tie structure can tie a shorter length tie so as to generate a tie knot which resembles a "four-in-hand" tie knot as shown in FIG. 2, in accordance with important features of my invention.

It will be obvious from the foregoing that I have provided an improved neck tie structure with a tie that has a reduced length as compared to ties that are ordinarily in use and where the overall costs of manufacture of the tie can be reduced because of the more limited amount of fabric required to manufacture a tie where used in a neck structure as here disclosed.

As various possible embodiments may be made in the above invention for use for different purposes and as various changes might be made in the embodiments and method above set forth, it is understood that all of the above matters here set forth or shown in the accompanying drawings are to be interpreted as illustrative and not in a limiting sense.

I claim:

1. In a neck tie structure, a tie, a neck band, fasteners on the neck band for forming opposite ends of the neck tie band in an annular shape, and a neck tie knot former, the neck tie knot former having an arcuate shaped upper end, a groove extending from side to side on the neck tie knot former, the neck band being extended through the groove, the neck band having fastener means at opposite ends to connect the neck band on a neck of a person wearing the tie, the tie having an intermediate tie loop portion mounted over a front face of the neck tie knot former with ends of the tie being projected along opposite sides and rearwardly of the neck tie knot former and rearwardly and beneath the neck band, the ends of the tie being extended upwardly and forwardly over the neck band between the intermediate tie loop portion and the neck tie knot former and being extended downwardly beneath the neck tie knot former in lapped relation, the thus tied tie generating a tied knot about the neck tie knot former which includes the intermediate tie loop portion, the tie former having an outwardly bulged curved front face, tapered side areas extending rearwardly on opposite sides of the outwardly bulged curved front face for allowing a tie knot to resemble a "for-in hand" tie knot, said knot to be tied over the outwardly bulged front face and the tapered side areas.

2. The neck tie structure of claim 1 wherein the knot former has its groove formed in an arcuate shape extending from one side of the knot former to an opposite side, the neck band when extended through the groove being flexible and shaped to adopt the arcuate shape of the groove.

3. The neck tie structure of claim 1 wherein the knot former is of a wedge-shaped configuration having a radially outwardly bulged curved front face.

4. The neck tie structure of claim 1 wherein the knot former when the band is engaged within the groove in the knot former, the knot former can move circumferentially relative to the neck band to enable the wearer to center the knot former relative to a chin of the wearer.

5. The neck tie structure of claim 1 wherein the knot former is comprised of a one piece of molded synthetic plastic, the groove being of a continuous annular shape and being located in adjacency to an upper edge of the neck tie former and immediately below the upper edge thereof.

6. The neck tie structure of claim 4 wherein the knot former is comprised of a one piece of molded synthetic plastic, the groove being located in adjacency to an upper edge of the neck tie former and immediately below the upper edge thereof.

7. The neck tie structure of claim 2 where a neck band sleeve has bunched areas along its length, the neck band sleeve has stitch means at its opposite ends connecting the sleeve integrally with said neck band, the neck band being elastic and expandable relative to the bunched areas but with branched areas on the sleeve being expandable to allow the sleeve to expand in length and to retract with the expansion and retraction of the elastic neck band, the sleeve being engageable in said arcuate groove and engageable with an arcuate wall surface defining said groove resisting relative movement but still allowing the knot former to be forcibly moved circumferentially relative to said neck band.

8. The neck tie structure of claim 2 wherein the knot former is of a wedge-shaped configuration having a curved front face, the curved front face comprising means for forming portions of the tie for generating a knot having an enlarged "Windsor" type knot in appearance.

9. The neck tie structure of claim 8 wherein a sleeve is mounted over the neck band, the sleeve being bunched on the neck band, stitch means at opposite ends of the sleeve anchoring opposite ends of the bunched sleeve to the neck band, the neck band being elastic and when expanded the bunched sleeve can expand with the neck band as bunches on the bunched sleeve are expandable with the elastic.

10. The neck tie structure of claim 1 wherein the knot former when the band is engaged within the groove in the knot former, the knot former can move circumferentially relative to the neck band to enable the wearer to center the knot former relative to a chin of the wearer, the arcuate groove in the knot former being stiff to hold its shape as the elastic neck band is expanded and contracted in the arcuate groove.

11. In combination, a neck tie structure, the neck tie structure including: a tie, a neck band structure including a neck band, and a wedge-shaped knot former, the wedge-shaped knot former having a groove formed in an arcuate shape extending across from side to side on the wedge-shaped knot former, the neck band being loosely extended through the groove for relative arcuate movement to the wedge-shaped knot former, the neck band having fastener means at opposite ends to connect the opposite ends of the neck band on a neck of a person wearing the tie, the tie having an intermediate tie loop portion mounted over and confronting a front face of the wedge-shaped knot former with the intermediate tie loop portion of the tie extended along opposite sides and rearwardly of the knot former and rearwardly and beneath the neck band, said intermediate tie portion being extended upwardly and forwardly over the neck band between the intermediate tie loop portion and the wedge-shaped knot former, the intermediate tie being extended downwardly beneath the wedge-shaped knot former in lapped relation to one another, the thus tied tie coacting with said knot former to generate an enlarged knot, the tie former having an outwardly bulged curved front face, tapered side areas extending rearwardly on opposite sides of the outwardly bulged curved front face for allowing a tie knot to resemble a "four-in-hand" tie knot, said knot to be tied over the outwardly bulged front face and the tapered side areas.

12. The combination of claim 11 wherein the wedge-shaped knot former is comprised of a one piece of molded synthetic plastic, the groove being located in adjacency to an upper edge of the neck tie former and immediately below the upper edge thereof and having an inside diameter exceeding an exterior diameter of said neck band structure.

13. The combination of claim 12 where a neck band sleeve is of an elastic construction, the neck band sleeve having stitch means at its opposite ends connecting the sleeve integrally with said neck band, the neck band being elastic and being expandable relative to the bunched sleeve but with bunched areas on the sleeve allowing the sleeve to expand in length and to retract with the expansion and retraction of the elastic neck band.

14. The combination of claim 11 wherein the tie portions extended beneath the wedge-shaped knot former having holder means to lock the tie portions against lateral movement and to hold them in vertical alignment with respect to one another.

15. In a neck tie structure, a tie, a neck band, and a neck tie knot former, the neck tie knot former having a groove formed in an arcuate shape and; extending from side to side on the neck tie knot former at an upper end thereof, the neck band being extended in a circumferential direction through the groove, the neck band having fastener means at opposite ends to connect the neck band on a neck of a person wearing the tie, the neck tie knot former having a radially outwardly bulged curved from face, tapered side areas extending rearwardly on opposite sides of the outwardly bulged curved front face; the tie having an intermediate tie loop portion comprising only a single layer of fabric mounted crosswise over said radially outwardly bulged curved front face of the neck tie knot former to generate an enlarged tie knot appearance with the intermediate tie loop portion of the tie being projected along opposite sides and rearwardly of the neck tie knot former and rearwardly and beneath the neck band, said intermediate tie portion being extended upwardly and forwardly over the neck band between the intermediate tie loop portion and the neck tie knot former and being extended downwardly beneath the neck tie knot former in lapped relation, the thus tied tie generating a tied knot about the neck tie knot former and its radially outwardly curved front face generating said enlarged tie knot appearance.

16. The neck tie structure of claim 15 wherein, the arcuate shape of said groove being of a smaller diameter than a diameter of the neck band, the neck band when extended through the groove being flexible and shaped to adopt the arcuate shape of the groove.

17. The neck tie structure of claim 16 wherein the neck tie knot former when the band is engaged within the groove in the neck tie knot former, the neck tie knot former can move circumferentially relative to the neck band to enable the wearer to center the neck tie knot former relative to a chin of the wearer.

* * * * *